United States Patent [19]

Choi

[11] Patent Number: 4,934,800

[45] Date of Patent: Jun. 19, 1990

[54] LOW COST LEVER HANDLE ENTRY FUNCTION

[75] Inventor: Mansam Choi, Monrovia, Calif.

[73] Assignee: Adams Rite Manufacturing Company, City of Industry, Calif.

[21] Appl. No.: 353,530

[22] Filed: May 18, 1989

[51] Int. Cl.[5] ..... E05C 19/00

[52] U.S. Cl. ..... 292/172; 292/244; 292/336.3; 292/DIG. 60

[58] Field of Search ..... 70/107, 462; 292/22, 292/39, 51, 112, 160, 172, 142, 199, 279, 280, 244, 245, 336.3, DIG. 60

[56] References Cited

U.S. PATENT DOCUMENTS

| | | | |
|---|---|---|---|
| 1,141,338 | 6/1915 | Hill . | |
| 1,158,446 | 11/1915 | Coffin | 70/462 |
| 1,161,972 | 11/1915 | Rehfuss . | |
| 2,772,905 | 12/1956 | Dusing . | |
| 3,011,330 | 12/1961 | Eads . | |
| 3,011,817 | 12/1961 | Eads . | |
| 3,097,007 | 7/1963 | Eichacker et al. . | |
| 3,214,947 | 11/1965 | Wikkerink . | |
| 3,271,982 | 9/1966 | Welch . | |
| 3,345,099 | 10/1967 | Paul et al. . | |
| 3,368,374 | 2/1968 | Eads . | |
| 3,608,127 | 9/1971 | Lewin . | |
| 3,705,739 | 12/1972 | Adler . | |
| 3,791,180 | 2/1974 | Doyle | 292/39 X |
| 3,811,717 | 5/1974 | Floyd et al. . | |
| 3,866,730 | 2/1975 | Balducci . | |
| 3,869,159 | 3/1975 | Eads . | |
| 3,873,141 | 3/1975 | Peterson . | |
| 4,003,593 | 1/1977 | Wilzig et al. . | |
| 4,007,954 | 2/1977 | Erickson . | |
| 4,012,066 | 3/1977 | Salvatore . | |
| 4,052,092 | 10/1977 | Bergen | 292/244 X |
| 4,145,900 | 3/1979 | Ohno . | |
| 4,218,903 | 8/1980 | Eads . | |
| 4,311,329 | 1/1982 | Kral . | |
| 4,458,928 | 7/1984 | Hirschbein . | |
| 4,725,085 | 2/1988 | Hu et al. | 292/172 |
| 4,726,613 | 2/1988 | Foshee . | |
| 4,809,526 | 3/1989 | Shen | 70/462 X |

FOREIGN PATENT DOCUMENTS

| | | |
|---|---|---|
| 2441396 | 7/1980 | France . |
| 2447439 | 9/1980 | France . |

*Primary Examiner*—Eric K. Nicholson

*Attorney, Agent, or Firm*—William W. Haefliger

[57] ABSTRACT

Door lock control apparatus includes a rotary input part adapted to be rotated by a handle or knob; a rotary output part adapted to operate a lock mechanism; and structure coupling the input part to the output part, including a pinion gear coupled to the output part; a member having first and second lengthwise extending racks thereon and bodily shiftable between a first position in which the first rack engages the pinion, and a second position in which the second rack engages the pinion, that member also being bodily movable in the length direction of the racks; and a mechanism operatively coupled between the input part and the member to have that member in the length direction in response to rotation of the input part; the racks located to alternately engage the pinion in such first and second positions so that in the member's first position the output part is rotated clockwise when the input part is rotated clockwise, and in the member's second position the output part is rotated counterclockwise when the input part is rotated clockwise, or vice versa depending on "handing".

12 Claims, 5 Drawing Sheets

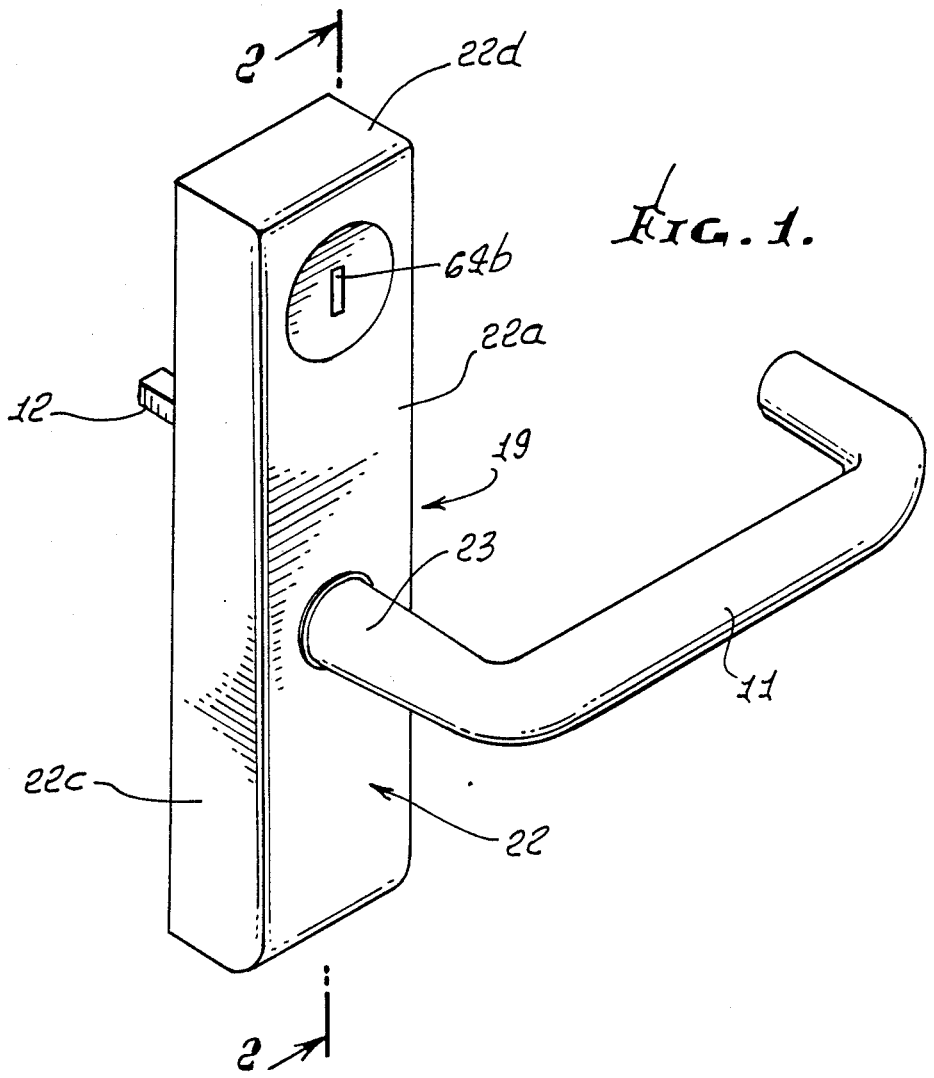
FIG. 1.
FIG. 1a.
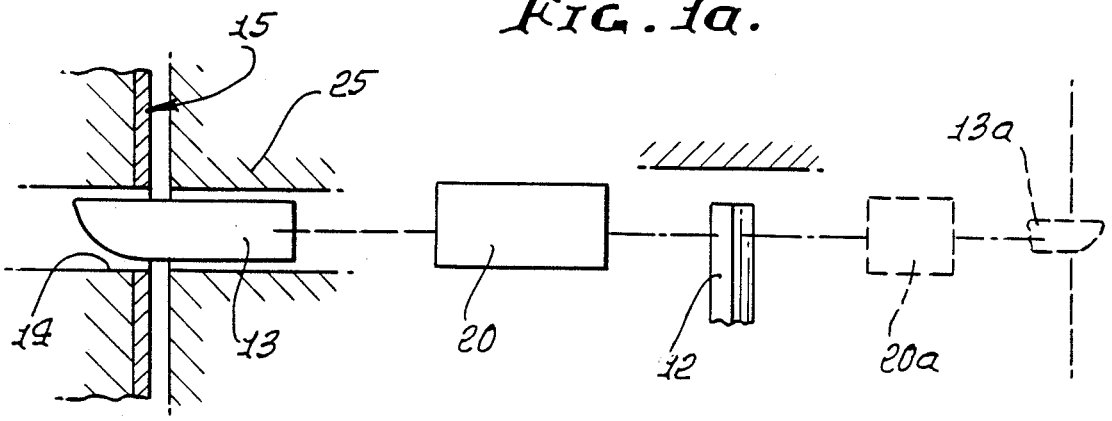

LOW COST LEVER HANDLE ENTRY FUNCTION

BACKGROUND OF THE INVENTION

This invention relates generally to door latch or rod actuators, and more particularly, to an improved actuator enabling installation in different configurations to enable opening of the latch when the door handle is installed to be swung either clockwise or counterclockwise, and when the handle is installed "right-handed" or "left-handed", to be swung in either direction, as will appear.

When door latch actuators carrying handles are installed, it may be necessary to produce either clockwise or counterclockwise rotation of the actuator output shaft, depending upon the installation; and it is desirable that a single actuator mechanism be usable for this purpose. Also, it is desirable that the same actuator mechanism be installable for either left or right-handed operation. There is need for a simple, rugged, easily adjustable mechanism that is "universal" in its adaptability to any of the above modes of operation.

Prior door latch actuators required removal of the handle, from a right-handed position, for example, and then reinstallation of the handle in a left-handed position, for example; and this procedure was time consuming and often required disassembly of much of the actuating mechanism so that springs, levers and other parts had to be laboriously reinstalled. Accordingly, there is great need for an actuator which can be easily adjusted for left or right-handed operation, with minimum consumption of time and without requiring extensive disassembly.

SUMMARY OF THE INVENTION

It is a major object of the invention to provide an improved latch actuating mechanism that is universal in its ability to be installed for operation in any of the above modes, i.e., to meet the above need. Basically, the mechanism of the invention includes:

(a) a rotary input part adapted to be rotated by a handle, (b) a rotary output part adapted to operate a lock mechanism, (c) and means coupling the input part to the output part including (i) a pinion gear coupled to the output part, (ii) a member having first and second lengthwise extending racks thereon and bodily shiftable between a first position in which the first rack engages the pinion and a second position in which the second rack engages the pinion, the member also being bodily movable in the length direction of the racks, (iii) and structure operatively coupled between the input part and the member to move the member in said direction in response to rotation of the input part, (d) the racks located to alternately engage the pinion in the first and second positions so that in the first position of the member the output part is rotated clockwise when the input part is rotated clockwise, and in the second position of the member the output part is rotated counterclockwise when the input part is rotated clockwise.

It is another object of the invention to provide apparatus in which the operating handle can be shifted from right to left-handed positions, or vice versa, without requiring handle removal or disassembly.

A further object is to provide an actuator which can be very simply adjusted from the exterior, and without requiring disassembly of the handle or remaining mechanism, to achieve shifting of "handedness", i.e., left to right, or right to left, of the handle.

As will be seen, the racks are typically linearly elongated, and face oppositely, and toward the pinion gear; also, insert means, such as pins adjustable from the exterior, are typically provided on a carrier to be alternately located in a first location to hold the member in first position, and in a second location to hold the member in its second position. In this regard, the direction of the member bodily movement in response to handle turning is typically normal to shifting of the member between its first and second positions.

An additional objective of the invention includes the provision of a pivotably mounted lock arm having a first pivoted position in which the movement of the member is blocked, and a second position in which the movement of the member is unblocked. A blocking part cooperates with the arm, to effect blocking and unblocking of the member.

A further object is to provide the member in the form of a plate having opposite single edges alternately guidably engagable with the insert means during plate movement to transmit movement between the rack means and pinion gear.

DRAWING DESCRIPTION

FIG. 1 is a perspective view of mechanism incorporating the invention;

FIG. 1*a* is a diagrammatic view of the output shaft of the FIG. 1 mechanism as used to operate a door latch;

DETAILED DESCRIPTION

Figure 2:
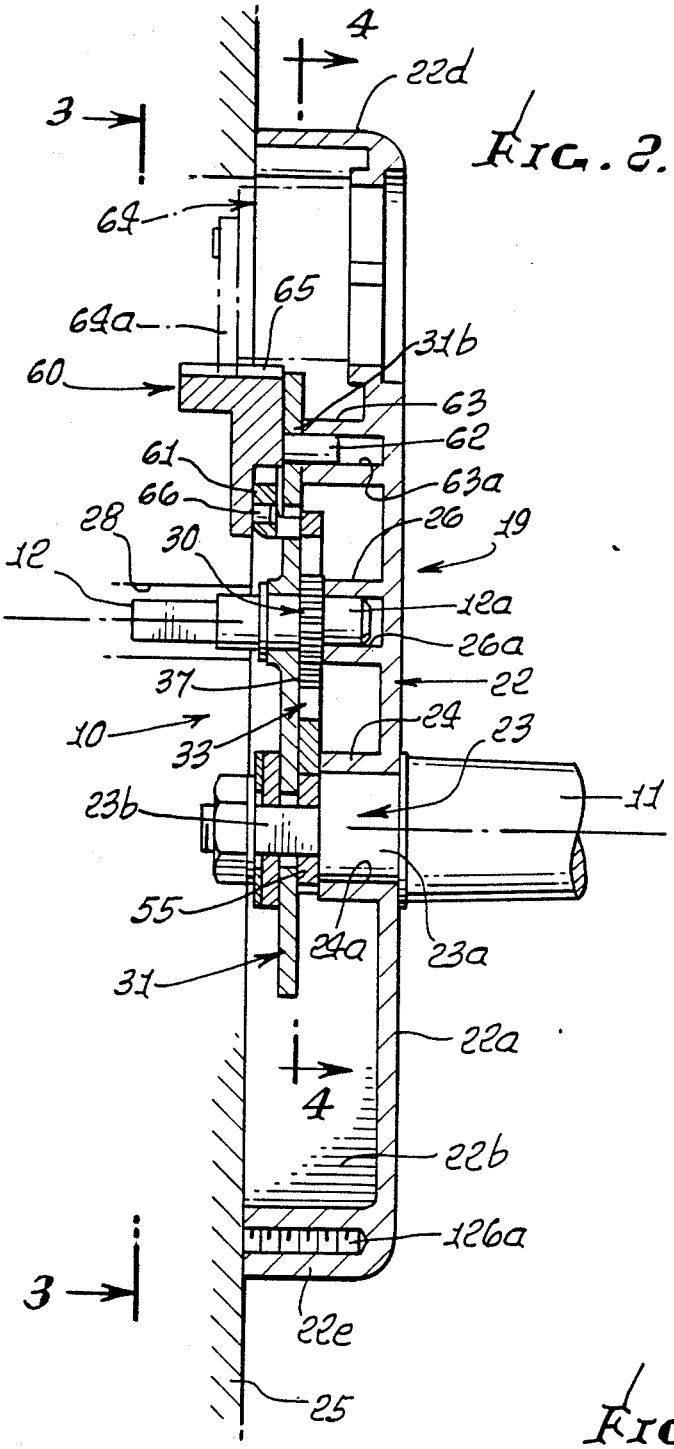
FIG. 2 is an enlarged vertical elevation, in section, on lines, 2—2 of FIG. 1.
Figure 10:
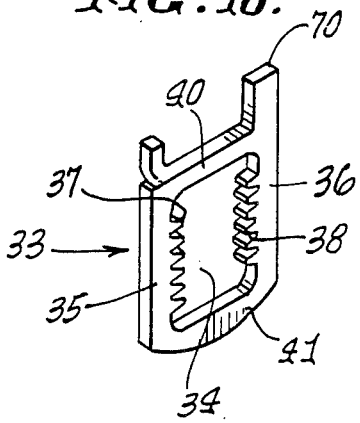
FIG. 10 is a perspective view of the rack member.

Referring first to FIGS. 1, 1*a*, and 2, apparatus 10 is shown for transferring door latch opening or closing motion (rotation) from a door handle 11 to an output shaft 12. When the handle is rotated clockwise, for example, the shaft 12 also rotates clockwise; and the apparatus 10 is such as to allow very simple shifting of a rack carrying member (to be described) in unit 19 to then produce counterclockwise rotation of the shaft 12 in response to clockwise rotation of the handle. In FIG. 1*a*, clockwise rotation of shaft 12 produces rightward, unlocking movement of a latch 13 relative to a latch receptacle 14 in a frame 15 via intermediate linkage mechanism 20; alternatively, after shifting of the rack member, counterclockwise rotation of the shaft 12 is produced to effect leftward unlocking movement of a latch 13*a* relative to a latch receptacle in a door frame, via intermediate mechanism 20*a*, seen in FIG. 1*a*.

In FIGS. 1 and 2, a housing shell 22 has an outer plate or face 22*a*, and a skirt defining skirt side walls 22*b* and 22*c*, and end walls 22*d* and 22*e*. The shell is typically metallic, and may be anodized. Attached to (or part of) the handle is a shaft 23 having a reduced diameter section 23*a* that rotatably fits within a bore or bearing 24*a* formed by shell tubular section 24, allowing handle and shaft rotation as described, and to be described. The shell is attachable to a door 25, as via fasteners 126*a* received in threaded openings 26.

The output shaft 12 has a cylindrical extension 12*a* that rotatably fits within a bore 26*a* defined by a shell tubular section 26, so that the shaft 12 projects into the door interior at 28, for operating the linking mechanism 20 or 20*a*, previously referred to. The shaft 12 may be suitably retained in position, axially.

Figure 8:
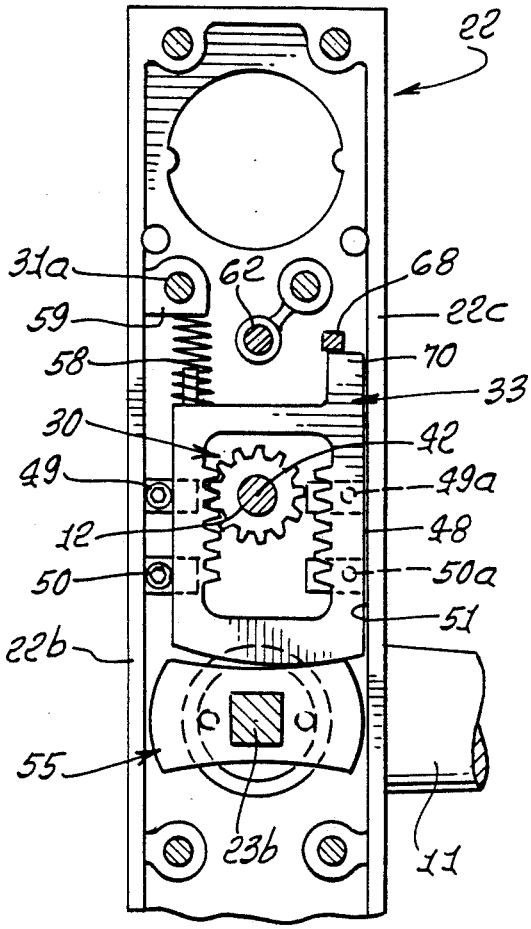
FIG. 8 is a view like FIG. 3, after shifting of a rack member to reverse the direction of output shaft rotation.

Means is provided for coupling the input shaft (or part) 23 to the output shaft (or part) 12, to facilitate the functions referred to as well as additional functions. Such means includes a pinion gear 30 rigidly coupled to or mounted o the output shaft, adjacent to and at the inner side of a back plate 31. The latter may be attached to the shell as via fasteners 31*a* and may engage the end of shell section 63, at 31*b*. Also located at the inner side of plate 31 is a rack member 33 (FIG. 4) in the form of a plate. The plate defines a window 34 between longitudinally extending stretches plate 35 and 36, there being racks 37 and 38 formed on the stretches to extend longitudinally linearly, at opposite sides of the window, as shown. Transverse plate members 40 and 41 interconnect the stretches 35 and 36 above and below the racks. The racks are spaced apart laterally, so that when the member 33 is shifted to a first (leftward) position as seen in FIG. 4, the rack 38 meshes with the pinion at one side of the pinion axis 42 of rotation; and when the member 33 is shifted to a second position (rightward) as seen in FIG. 8, the rack 37 meshes with the pinion at the opposite side of the pinion axis 42.

Figure 3:
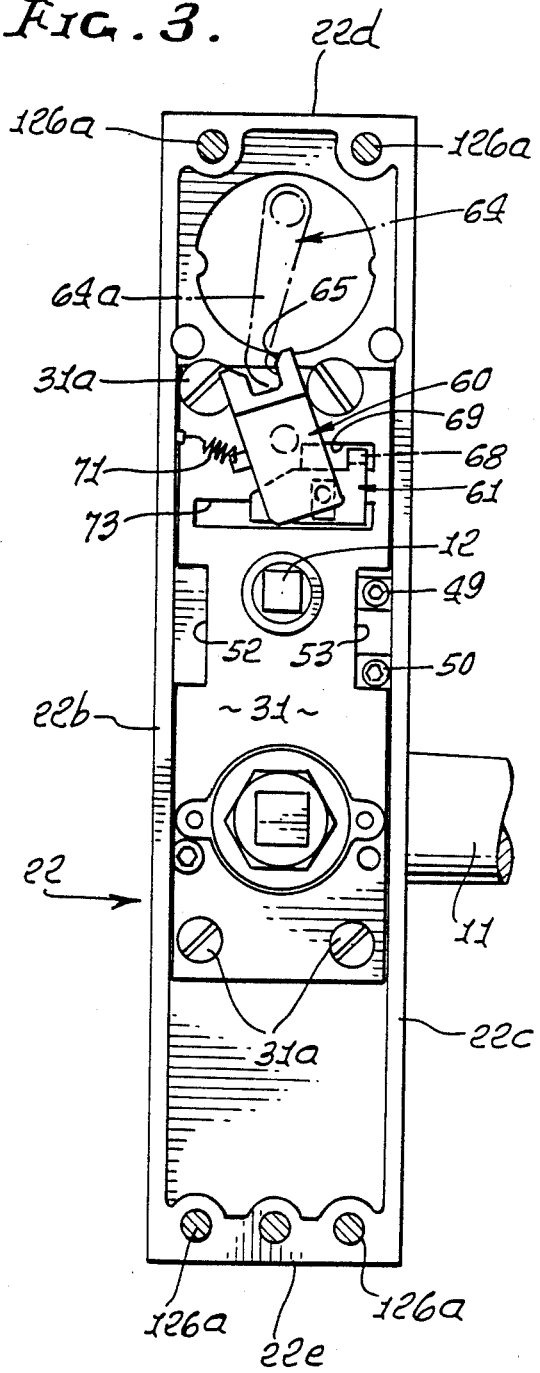
FIG. 3 is an elevation taken on lines 3—3 of FIG. 2, before handle turning.
Figure 4:
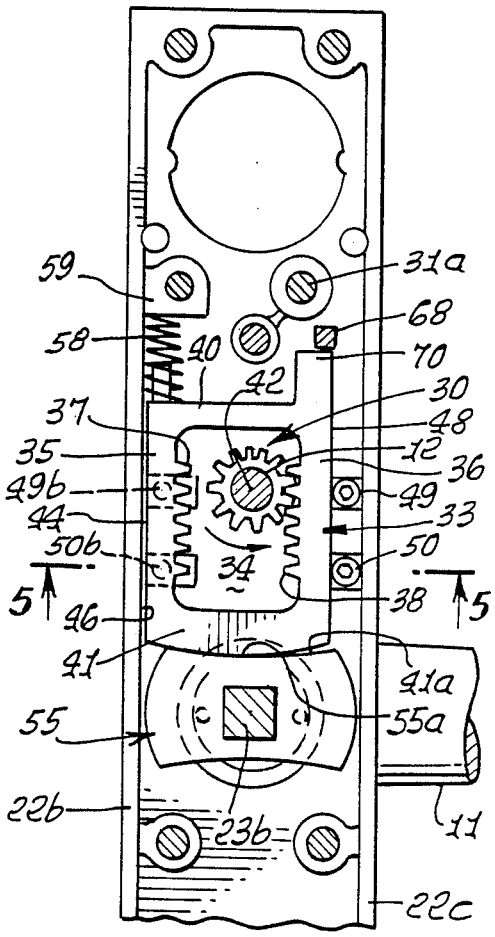
FIG. 4 is an elevation taken on lines 4—4 of FIG. 2.
Figure 5:
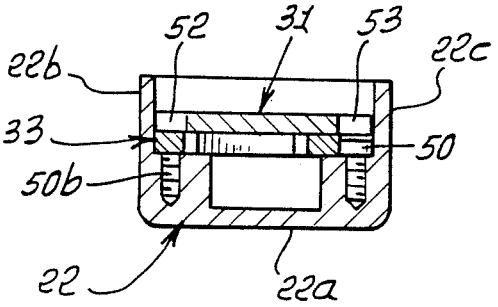
FIG. 5 is a horizontal section on lines 5—5 FIG. 4.
Figure 7:
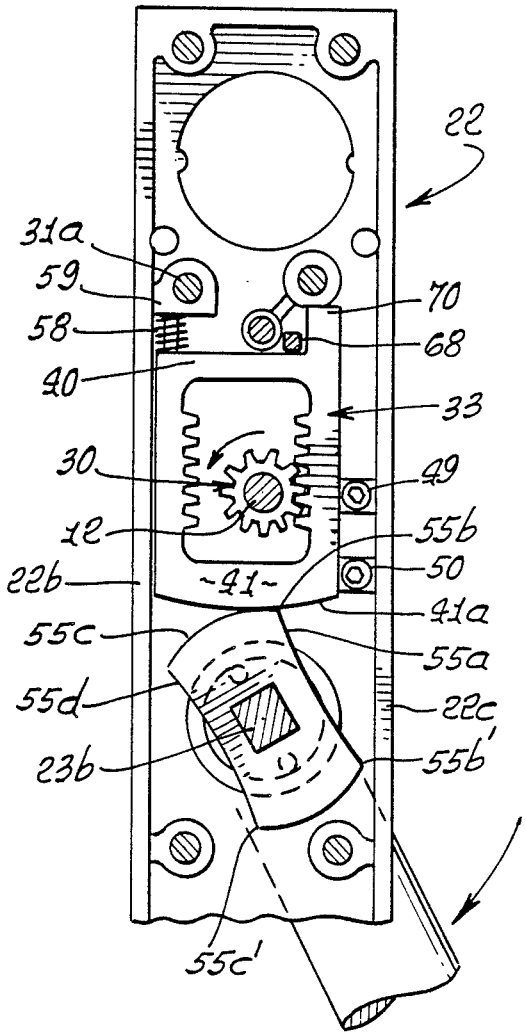
FIG. 7 is a view like FIG. 4, taken after handle turning.
Figure 9:
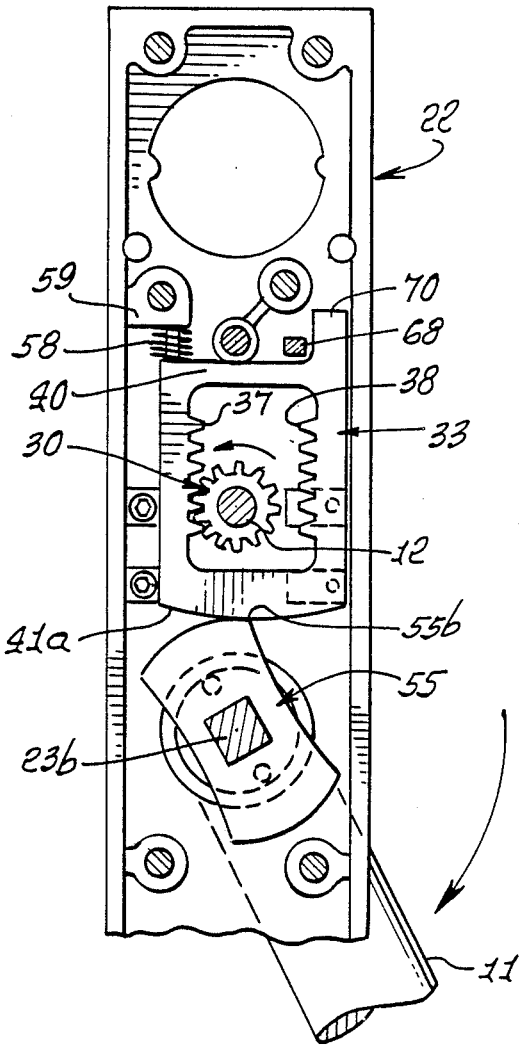
FIG. 9 is a view like FIG. 7, after shifting of a rack member to reverse the direction of output shaft rotation.
Figure 14:
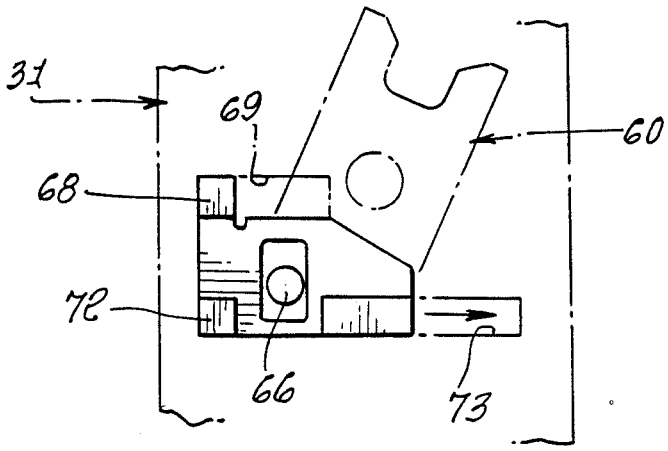
FIG. 14 is an end view taken on lines 14—14 of FIG. 13, and also showing interrelation with the lock arm member.
Figure 15:
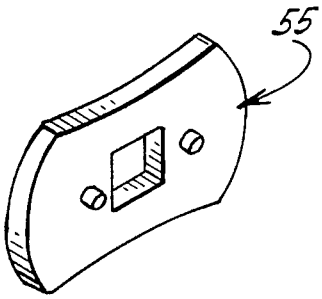
FIG. 15 is a perspective view of a rotary cam.

Member 33 is also bodily movable in the length direction of the two racks, i.e., longitudinally, as between the position seen in FIG. 4, and the position seen in FIG. 7, to effect rotation of the output shaft 12 as the handle 11 is turned. During such movement, the racks are displaced longitudinally, so that whichever rack engages the pinion rotates it. Thus, if rack 38 engages the pinion, the output shaft is rotated in one direction, and if the rack 37 engages the pinion, the output shaft is rotated in the opposite direction. The member 33 is guided during such movement as in FIG. 4 and FIG. 7, by sliding engagement of outer edge 44 of the stretch 35 with the inner side or face 46 of skirt section 22*b*, and by sliding engagement of outer edge 48 of the stretch 36 with inserts 49 and 50 received in openings 49*a* and 50*a* (see FIG. 8) in shell 22. In FIGS. 8 and 9, the inserts have been removed from 49*a* and 50*a* and inserted into openings 49*b* and 50*b* (see FIG. 4) in shell 22, and thus the outer edge 48 of stretch is then slidably guided by the inner side or face 51 of the skirt section 22*c*, and plate edge 44 is guided by sliding engagement with the two inserts 49 and 50. Since plate 31 is cut-away at 52 and 53 over the alternate insert locations, as seen in FIG. 3, the inserts can easily be manually inserted in either FIG. 3 or FIG. 8 positions, to achieve the desired direction of output shaft rotation, to meet door latch installation requirements, and no disassembly of the apparatus is required.

Structure is provided to be operatively coupled between the input part (or shaft) 23 and the plate member 33 to move that member longitudinally, as described, in response to handle 11 and part 23 rotation. Such structure may advantageously take the form of a cam 55 mounted on extension 23*b* of shaft 23, that projects leftwardly in FIG. 2, within shell 22. That extension 23*b* may for example have polygonal cross section (or other cross section) so long as the carrier is keyed to the extension. Cam 55 has a concave edge 55*a* facing upwardly to engage the convex edge 41*a* of plate part 41, whereby when cam 55 is rotated, as in FIG. 7, edge 55*a* urges the edge 41*a* and the plate 33 upwardly, the edge 41*a* riding over the corner 55*b* and onto convex edge 55*c* of the cam, as shown. This ultimate engagement of 41*a* and 55*c* coincides with the upper limit of plate movement, and also provides stable positioning or "plateau-ing" of the cam 55 so that the full form of return spring 58 is not then exerted back to the handle. Compression spring 58 is retained between the top 40 of the plate and a fixed abutment 59 on the shell. See FIG. 4. Note that the curvature of cam concave surface 55*a* is greater than the curvature of the convex surface 41*a* of the plate, so that the cam will lift the plate in either lateral position of the plate 33 (i.e., FIG. 4 and FIG. 8). Symmetrical positioning of corners 55*b* and 55*c*, and 55*b'* and 55*c'* of the cam also enable cam operation should handle 11 be lifted rather than depressed, and should the handle be metallic to project to the left in FIG. 4, rather than to the right When handle 11 keeps turning clockwise and overcomes the force of spring 58, "handedness" of the handle is reversed. At this reversed position, bottom 41*a* of plate 33 can slide onto surface 55*d* of cam 55, as the cam has a symmetric shape.

Figure 11:
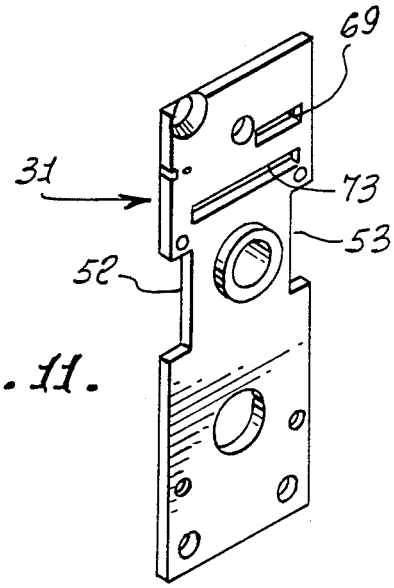
FIG. 11 is a perspective view of a bulk plate member.
Figure 6:
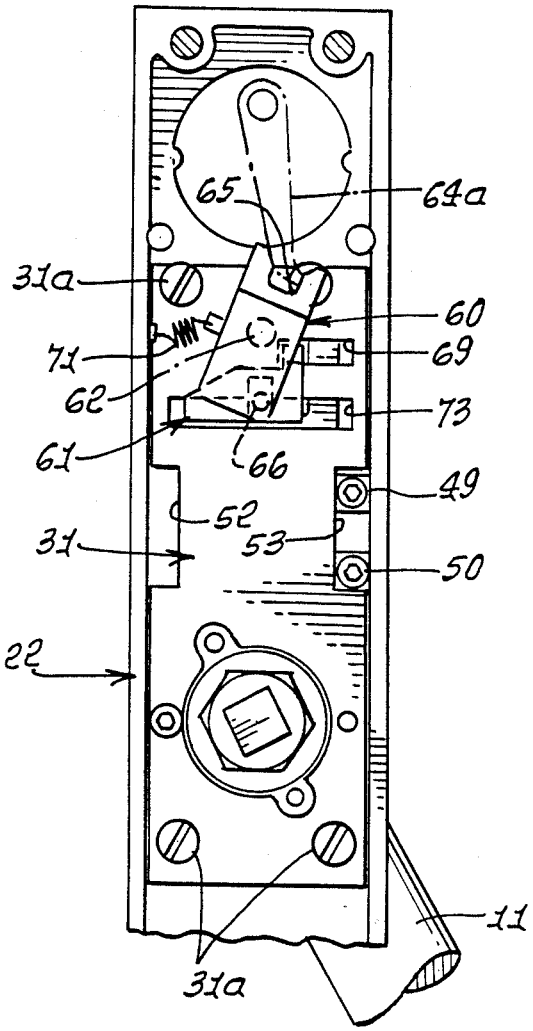
FIG. 6 is a view like FIG. 3 taken after handle turning.
Figure 12:
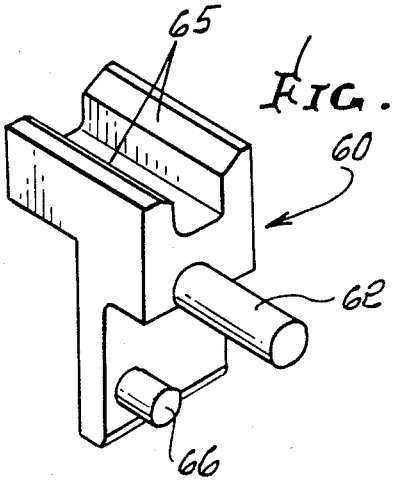
FIG. 12 is a perspective view of a lock arm member.
Figure 13:
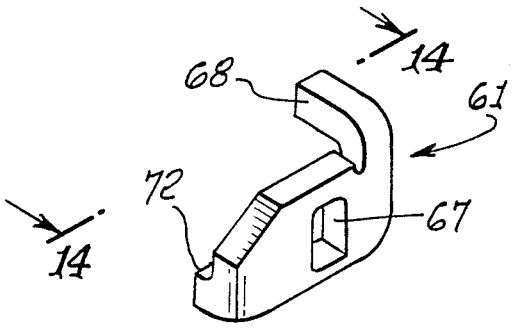
FIG. 13 is a perspective view of a stop member.

Also provided is a pivotally mounted lock arm as at 60 having a first pivoted position (see FIG. 3) in which upward movement of plate member 33 is blocked as by means of a blocking part 61, and also having a second pivoted position (see FIG. 6) in which such upward movement of plate member 33 is unblocked (i.e., freed) by means of now shifted positioning of blocking part 61. As seen in the drawings including FIG. 2 and FIG. 12, the arm 60 has a pivot 62 received in a bore 63*a* in the carrier (shell) structure 63 to allow pivoting of the arm 60 in response to rotation of arm 14*a* a lock actuator 64 that may be key operated. See key slot 64*a* in FIG. 1. Arm 64*a* is received in and has lost motion relative to U-shaped upper extent 65 of the arm 60. Arm 60 also has a tang 66 received in a slot 67 in blocking part 61 so as to shift the latter laterally between FIG. 3 and FIG. 6 positions. Part 61 has a turned tang 68 that extends through a guide slot 69 in plate 31, to guide the part 61 as it is moved, the end of that tang 68 projecting into blocking relation with shoulder 70 on the plate 33, as seen in FIG. 4. See also FIG. 11. When the blocking part is shifted to FIG. 6 position, the tang no longer obstructs shoulder 70. A spring 71 urges arm 60 clockwise, as shown. Ledge 72 of the part 61 rides in lateral slot 73 in the plate 31, for additional lateral guidance of the blocking part.

I CLAIM:

1. In a door lock control apparatus, the combination comprising (a) a rotary input part adapted to be rotated by a handle, (b) a rotary output part adapted to operate a lock mechanism, (c) and means coupling said input part to said output part including (i) a pinion gear coupled to said output part, (ii) a member having first and second lengthwise extending racks thereon and bodily shiftable between a first position in which the first rack engages the pinion and a second position in which the second rack engages the pinion, said member also being bodily movable in the length direction of the racks, (iii) and structure operatively coupled between said input part and said member to move said member in said length direction in response to rotation of said input part, (d) said racks located to alternately engage the pinion in said first and second positions so that in said first position of the member the output part is rotated clockwise when the input part is rotated clockwise, and in said second position of the member said output part is rotated counterclockwise when the input part is rotated clockwise.

(e) and carrier means for said input and output parts and coupling means.

2. The combination of claim 1 wherein the racks are linearly elongated, and face oppositely and toward the pinion gear.

3. The combination of claim 1 including insert means on the carrier means to be alternately located in a first location to hold the member in said first position, and in a second location to hold said member in its said second position.

4. The combination of claim 1 wherein said length direction of member bodily movement is normal to said shifting of said member between said first and second positions.

5. The combination of claim 1 including a pivotably mounted lock arm having a first pivoted position in which said movement of the said member is blocked, and a second position in which said movement of the said member is unblocked.

6. The combination of claim 5 including a blocking part on the carrier means and shiftable between a member blocking position and a member unblocking position, in response to pivoted movement of the lock arm.

7. The combination of claim 2 wherein said member comprises a plate having a window therethrough, and in which the pinion gear is located, the plate having elongated stretches on which the two racks are formed.

8. The combination of claim 3 wherein said member has opposite edges respectively engagable with said insert means, and with a guide surface on the carrier means thereby to guide the member for movement in the length direction of the racks.

9. The combination of claim 6 including a plate on the carrier and through which said output part projects, the blocking part located at the side of the plate opposite the member and pinion gear, and a tang on the blocking part projecting through the plate to block lengthwise movement of the member in one position of the blocking part.

10. The combination of claim 1 wherein said structure comprises a cam having a concave surface engagable with a convex surface of said member in either of said first and second positions thereof 11. The combination of claim 10 wherein the cam has corners at opposite ends of said concave surface and over one of which the members convex surface rides in response to handle rotation in opposite directions, respectively.

12. The combination of claim 10 wherein the cam has an axis of rotation, and a second concave surface engagable with the convex surface of said member when the cam is rotated about 180° about said axis, whereby the handedness of the handle is then reversed.

* * * * *